US007050735B2

(12) United States Patent
Bardolatzy et al.

(10) Patent No.: US 7,050,735 B2
(45) Date of Patent: May 23, 2006

(54) OPERATING UNIT WITH USER ACCOUNTS FOR AN ELECTRO-PHOTOGRAPHIC PRINTING SYSTEM OR COPYING SYSTEM

(75) Inventors: Ulrich Bardolatzy, Poing (DE); Bernd Sorgenfrei, Munich (DE); Michael Flexeder, Poing (DE); Andreas Hirn, Pliening (DE)

(73) Assignee: Oce Printing Systems GmbH, Poing (DE)

( * ) Notice: Subject to any disclaimer, the term of this patent is extended or adjusted under 35 U.S.C. 154(b) by 99 days.

(21) Appl. No.: 10/692,248

(22) Filed: Oct. 23, 2003

(65) Prior Publication Data

US 2004/0131377 A1 Jul. 8, 2004

(30) Foreign Application Priority Data

Oct. 28, 2002 (DE) ..... 102 50 187

(51) Int. Cl.
*G03G 15/00* (2006.01)
*G03G 21/02* (2006.01)

(52) U.S. Cl. ..... 399/79; 399/81

(58) Field of Classification Search ..... 399/79–81; 713/182

See application file for complete search history.

(56) References Cited

U.S. PATENT DOCUMENTS 6,697,091 B1 * 2/2004 Rzepkowski et al. ..... 399/81

FOREIGN PATENT DOCUMENTS

| | | | |
|---|---|---|---|
| DE | 196 04 323 | | 8/1996 |
| DE | 691 19 015 | | 11/1996 |
| EP | 0 727 718 | | 8/1996 |
| EP | 0 843 230 | | 5/1998 |
| JP | 06130766 A | * | 5/1994 |
| JP | 2002152446 A | * | 5/2002 |

* cited by examiner

*Primary Examiner*—Arthur T. Grimley
*Assistant Examiner*—Ryan Gleitz
(74) *Attorney, Agent, or Firm*—Schiff Hardin LLP

(57) ABSTRACT

In an operating unit for an electrophotographic printing or copying system, the operating unit has a graphical user interface with input and/or output fields, with help of which an operation of the electrophotographic printing or copying system occurs. A user account is selectable from at least two preset user accounts. A setting of at least one input and/or output field of the graphical user interface is adjustable for at least one user account.

16 Claims, 7 Drawing Sheets

OPERATING UNIT WITH USER ACCOUNTS FOR AN ELECTRO-PHOTOGRAPHIC PRINTING SYSTEM OR COPYING SYSTEM

BACKGROUND OF THE INVENTION

The invention concerns an operating unit for an electrophotographic printing or copying system. The operating unit has a graphical user interface with input and output fields, with whose help an operation of the electrophotographic printing or copying system occurs.

Known electrophotographic printing or copying systems comprise an operating unit via which the processing (execution) of print jobs, the operating mode of the printer, and parameters and set values are shown to operating personnel with the aid of a graphical user interface, whereby the operating personnel implement operator control actions via inputs. The set values concern in particular parameters of the printer or copier that operating personnel must adjust to implement different print jobs. For service and maintenance tasks that require access to internal control variables of the printer or copier, a special service and maintenance computer is connected with the printer or copier. The control variables are shown via a user interface of the service and maintenance computer, whereby at least one part of these control variables can be changed. In general, it is not expedient to allow the operating personnel access to set values and parameters of the printer or copier, in particular not when an impairment of the print quality or a damage of components of the printer is possible given a wrong setting. On the operating unit, the operating personnel are thus only allowed operating inputs for operation of the printer or copier that are necessary for processing of print jobs. The further adjustments are only possible via the maintenance computer.

SUMMARY OF THE INVENTION

It is an object of the invention to specify an operating unit for an electrophotographic printing or copying system via which a simple and clear operation of the printing or copying system is possible, both in the processing of print jobs and in service and maintenance tasks. Furthermore, a graphical user interface and a method to operate an electrophotographic printing or copying system is to be provided.

In the system and method for operating an electrophotographic printing or copying system, the electrophotographic printing or copying system is operated with aid of a graphical user interface with at least one of input and output fields. The user account is selected from at least two user accounts. At least one setting of at least one of an input and an output field of the graphical user interface is adjusted for at least one user account.

DESCRIPTION OF THE PREFERRED EMBODIMENT

Figure 1:
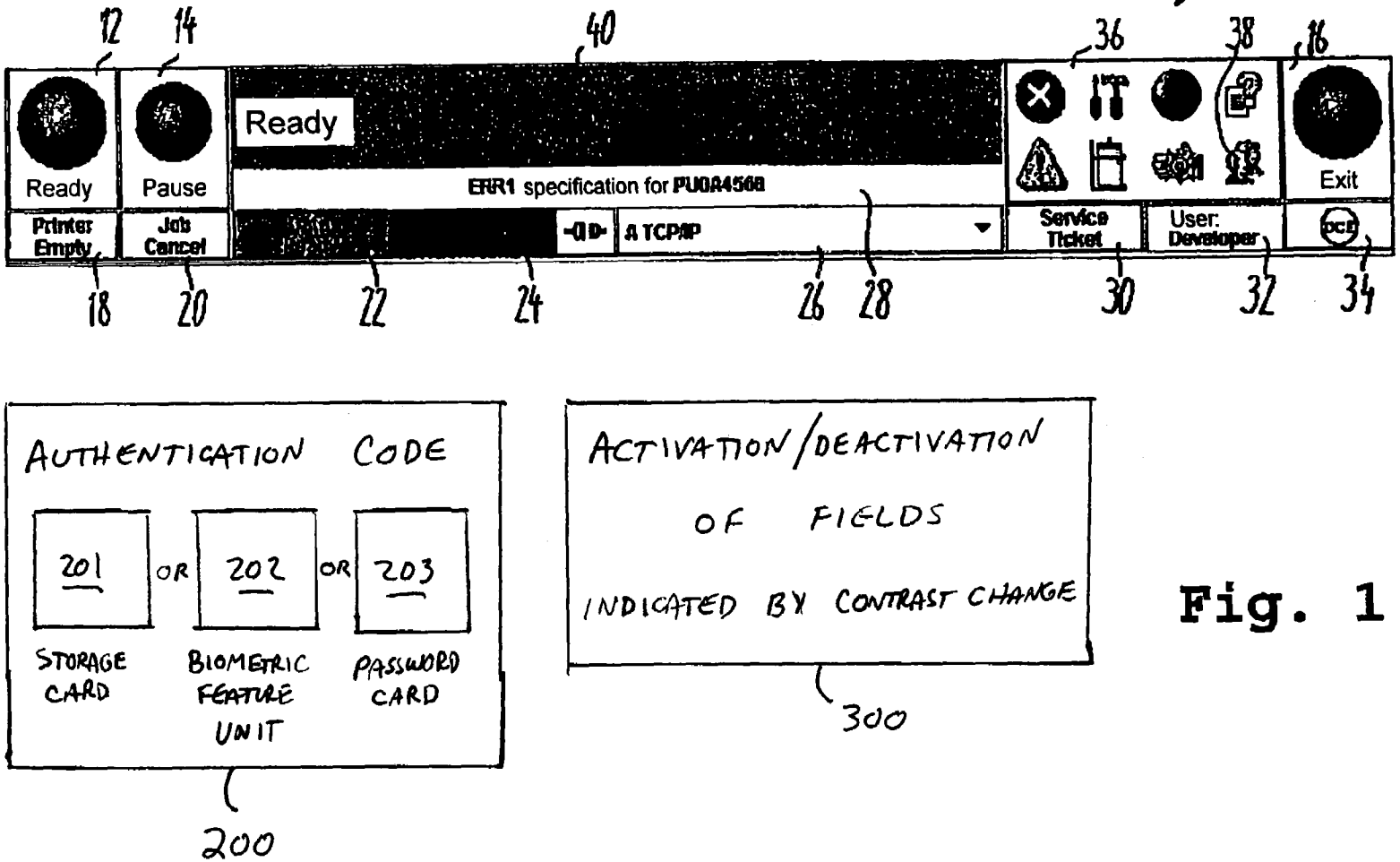
FIG. 1 shows a section of a graphical user interface with a toolbar.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

It is possible via an operating unit to assign separate access rights to at least two different users. Thus, for example, a first user account can be associated with operating personnel , and a second user account can be associated with a service technician. The input and/or output field of the graphical user interface can then be configured for the operating personnel such that via this input and/or output field only one output of data occurs, and the operating personnel can undertake no inputs. The same data are output to the service technician via the input and/or output field, whereby the service technician can also input further data via the input field. Furthermore, two operating personnel can be assigned different access rights via an operating unit. It is thereby achieved that specific adjustments or changes of existing adjustments can only be implemented by qualified operating personnel, and the typical operator control actions can also be implemented by other operating personnel. With the aid of the graphical user interface, unchangeable set values can then not be shown, or are shown deactivated for the typical operating personnel.

A second aspect concerns a method to operate an electrophotographic printing or copying system. The electrophotographic printing or copying system is operated with the aid of a graphical user interface with input and/or output fields. At least one user account is selected from at least two user accounts. At least one setting of an input and/or output field of the graphical user interface is adjustable for at least one user account.

With the method, it is thereby achieved that simple access rights can be assigned with the aid of such a user account. Via the access rights, it is furthermore achieved that specific operator control actions can only be implemented by operating personnel and/or service technicians qualified for them. The typical operating personnel then receives only access to operating elements and set values that are necessary for a normal operation given the processing of print jobs.

A third aspect concerns a graphical user interface to operate an electrophotographic printing or copying system. With the aid of input and/or output fields of the graphical user interface, at least one electrophotographic printing or copying system is operable. A user account is selectable from at least two prefixed user accounts. At least one setting of an input and/or output field of the graphical user interface is adjustable for at least one user account.

Via this graphical user interface, it is achieved that both the normal operation of the printing or copying system and adjustments for service and maintenance tasks can be implemented with the aid of the same graphical user interface and the same operating unit. It is also achieved via such a graphical user interface that the operating personnel are allowed, with the aid of the user accounts, different access rights to operating functions of the printing or copying system, whereby qualified operating personnel can be allowed more access rights than other operating personnel. A simple and clear operation is thereby possible with the aid of such a graphical user interface. Errors via user inputs by operating personnel not specifically trained are thereby prevented.

To better understand the present system and method, reference is made in the following to the preferred exemplary embodiments shown in the drawings, that are specified using specific terminology. However, it is to be noted that the scope of protection of the invention should not thereby be limited, since such changes and further modifications to the shown devices and/or the method, as well as such further applications of the invention as they are shown therein, are viewed as typical present or future expert knowledge of a competent average man skilled in the art.

A section 10 of a graphical user interface for an electrophotographic printer is shown in FIG. 1 that comprises what is known as a toolbar with input and output fields, output fields, and graphical function keys. Such graphical function keys are also called buttons. The toolbar 10 comprises graphical function keys 12, 14, 16 that concern the basic functions to operate the printer, such as generation of print readiness, stopping or pausing, and deactivation of the printer. With a further function key 18, the printer memory can be deleted, and with a further function key 20 a print job can be interrupted. With the aid of a display field 22 of the toolbar, it is shown whether data of a current print job to be processed are present. With the aid of the graphical function key 24, the entire print system can be reset and started anew. With the aid of what is known as a pull-down menu 26, a selected print channel is shown that has been selected from a plurality of possible print channels with the aid of the pull-down menu.

With the aid of the output field 28, the error that occurred last, or the last shown alarm, is shown with the aid of an error code or a plain text output, whereby a graphical function key is deposited in this output field 28, via which an error list with errors that have previously occurred is output in a display region of the graphical user interface. With the aid of the graphical function key 30, what is known as a service ticket (that comprises the suggestion to remove the error and/or comprises all important settings and data of the printer) can be called for the current occurring error, in order to show in a section of the graphical user interface (not shown) the information relevant to the error, given receipt of a contact with a service station of the printer manufacturer, and/or to be sent as a notification to such a service center.

The name of the currently selected user account is output in the output field 32. With the aid of the graphical function key lodged in the display field, a menu can be shown for selection of a user account from the existing user accounts. With the aid of the graphical function key 34, contact can be made with the service station of the printer manufacturer. Further graphical function keys are comprised in a region 36 of the toolbar 10, whereby with the aid of the graphical function key 38 at least one user interface can be activated to configure user accounts.

Given the selection of a user account, an authentication of the user is preferably implemented with the aid of an authentication code 200. The authentication code can thereby be comprised in data stored on a storage card 201, in biometric features of the operating personnel from a biometric feature unit 202, and/or in a password of the operating personnel such as from a password source 203. The toolbar 10 furthermore comprises a display region 40 in which a current operating state of the printer is shown, whereby the background color of the display region 40 is adjusted dependent on the operating state of the printer.

Figure 2:
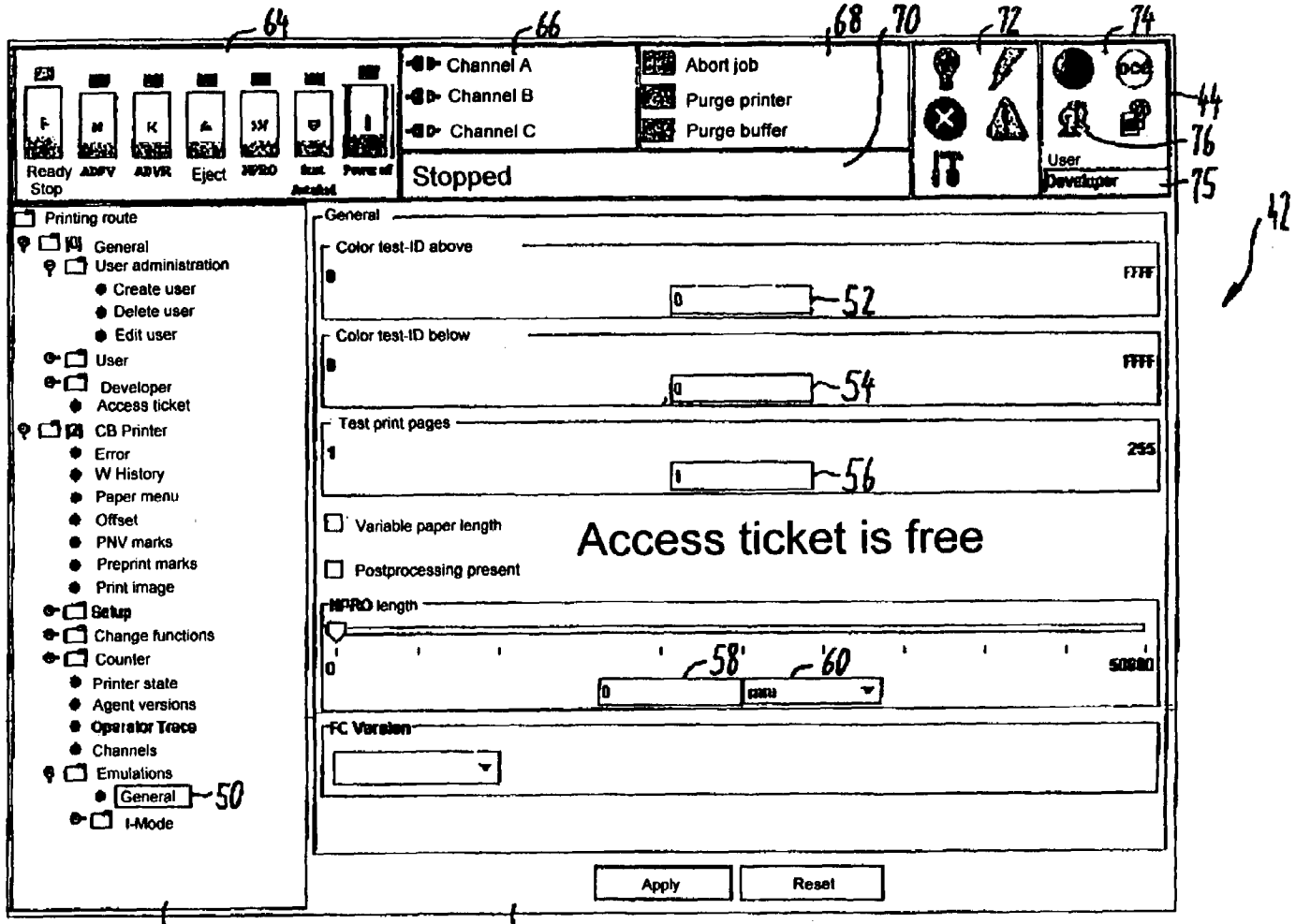
FIG. 2 illustrates a graphical user interface for an electrophotographic printer according to a second exemplary embodiment.

A graphical user interface 42 according to a second exemplary embodiment is shown in FIG. 2. The graphical user interface 42 comprises a first section 44 with a toolbar, a second section 46 with a menu, whereby with the aid of menu items a user interface is selectable from a plurality of user interfaces. The graphical user interface comprises a third section 48 in which the user interface selected with the aid of the menu item is shown. The graphical user interface 42 is output on a plurality of operating units of the print system, whereby individual operating units are also arranged separate from the printer and, for example, are comprised in a print server that supplies print data to the printer. However, of these operating units, only one operating unit at a time can implement write access.

The printer comprises what is known as a control panel server that provides the data to generate the graphical user interface and are the write accesses of the operating units. The control panel server assigns what is known as an access ticket to an operating unit that wants write access. The access ticket can only be assigned to one operating unit at a time. It is shown in the control panel 48 that the access ticket is currently not assigned, whereby the operating personnel is informed that write accesses are possible when the access ticket is requested. Given the input of a set value, the access ticket is then automatically requested by the respective operating unit at which the graphical user interface 41 is displayed.

The menu item 50 has been selected in the menu 46, whereby in the section 48 of the user interface 42 a user interface is displayed to adjust parameters of a printer emulation. This user interface has input and output fields 52, 54, 56, 58 in which number values are output, and whereby new number values can be input into the input and output fields 52, 54, 56, 58 with the aid of a keyboard (not shown). Further input and output fields 60, 62 are implemented as what are known as pull-down menus, whereby, with the aid of the arrow comprised in this output field, a menu is opened below in which a plurality of possible set values (for example, a plurality of possible measurement units) are comprised, whereby a desired set value can be selected from the displayed set values.

The toolbar 44 comprises a region 64 with graphical function keys that coincide in arrangement, shape, color and symbolism with keys that are present as hardware on the printer. These graphical function keys serve to control basic functions of the printer. Possible printer channels are displayed in the section 66 of the toolbar 44, whereby a channel can be selected by operating personnel that is then correspondingly graphically characterized according to the selection. In a section 68 of the toolbar 44, print jobs can be interrupted and/or deleted with the function keys. Furthermore, the toolbar 44 comprises an output field 70 in which the current operating state of the printer is shown.

In the sections 72 and 74 of the toolbar 44, the graphical function keys are substantially shown as in the toolbar according to the first exemplary embodiment according to FIG. 1 in the region 36. Furthermore, the region 74 of the toolbar 44 comprises the name of the currently selected user account. In the same manner as specified in connection with FIG. 1, a user account can be selected from a plurality of user accounts. With the aid of the graphical function key 76, a user interface is called to set up user accounts.

Activation or deactivation of input/output fields may be indicated within tool bar 10, such as by a contrast change indicated in FIG. 1 at 300.

Figure 3:
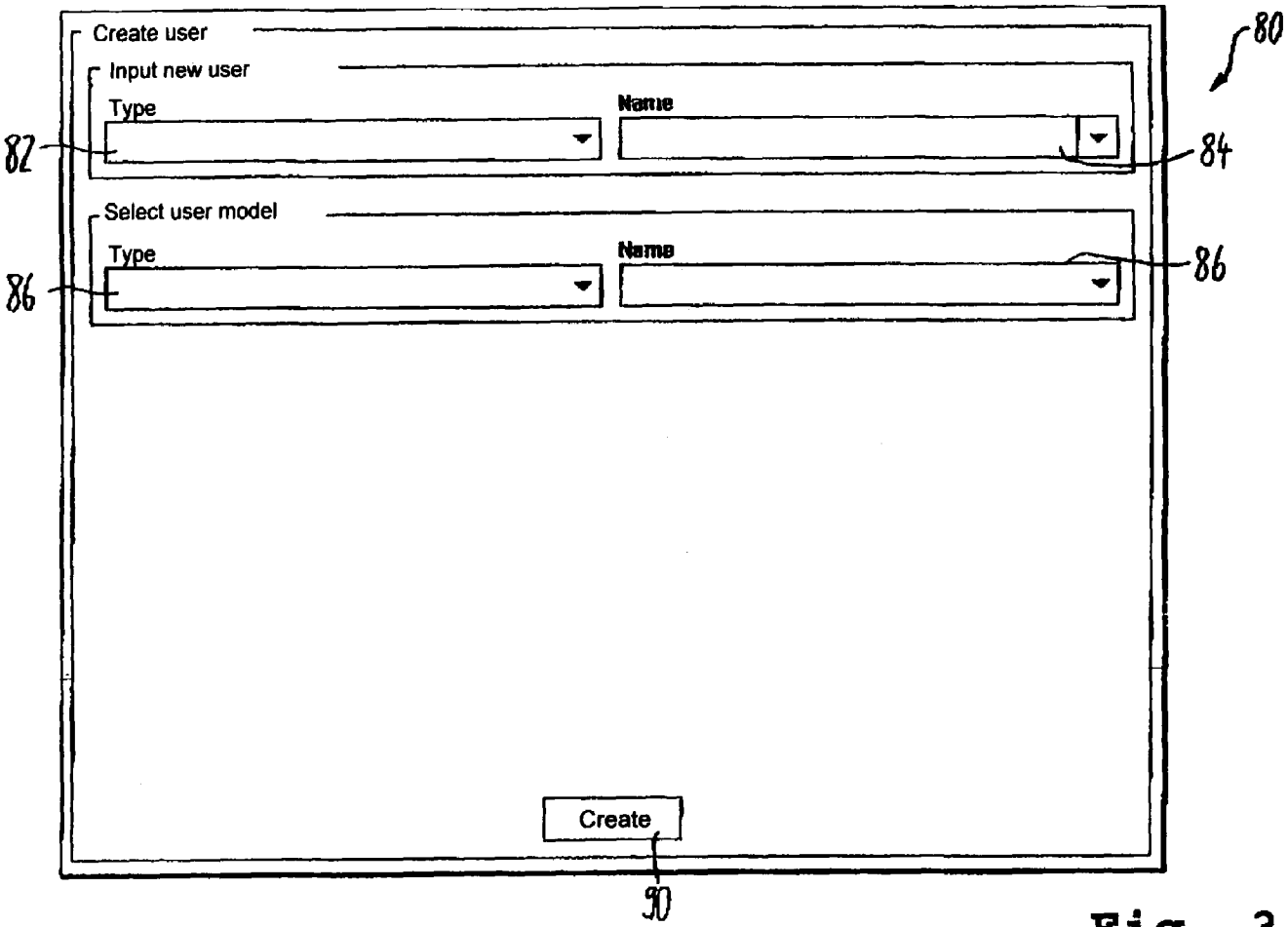
FIG. 3 shows a control panel to generate and administer user accounts.

A user interface 80 to generate a new user account is shown in FIG. 3. The user interface 80 is shown after activation of the graphical function key 76 in the section 48 of the graphical user interface 42. In the input and output field 82 in the user interface 80, a type of new user account to be generated is input. This type can be selected with the aid of a pull-down menu that can be called in the input and output field 82 via the arrow. The name of the new user account to be established is input into the input and output field 84 of the user interface 80.

In the input and output field 86, a type of user model that forms the basis of a new user account to be established can be selected with the aid of a pull-down menu. The type of user model that serves as the basis for the new user account to be established according to the selection can thereby be set in the input and output field 86, and the name of the user model can thereby be set in the input and output field 88.

Figure 4:
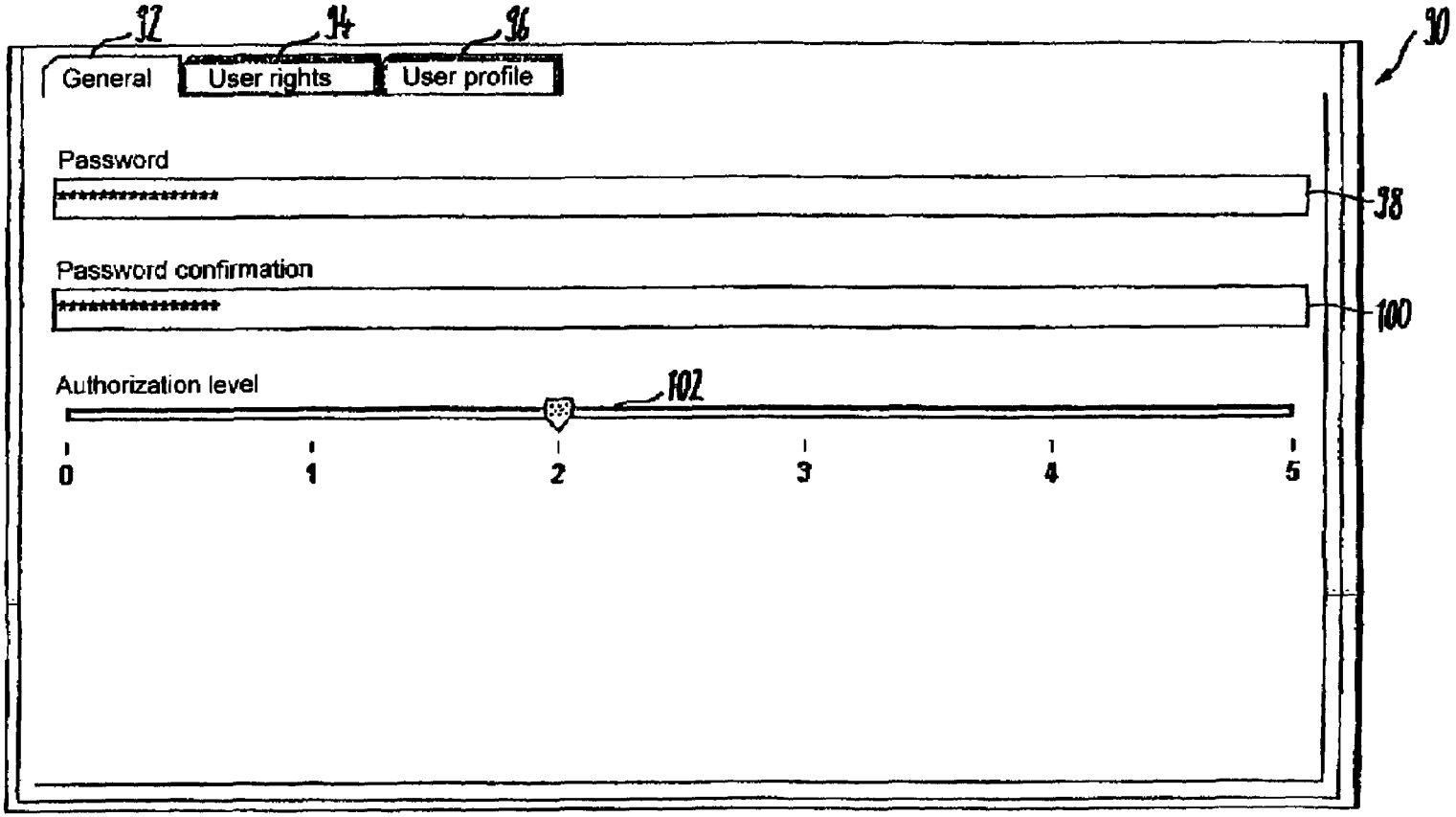
FIG. 4 illustrates a control panel to associate a password and an authorization level to a user account previously established according to FIG. 3 with the aid of the control panel.

After inputs have at least been effected in the fields 82 and 84, the new user account can be created with the aid of the graphical function key 90. The user interface 90 shown in FIG. 4 is shown via activation of the graphical function key 90 in the section 48 of the graphical user interface 42 according to FIG. 2. This user interface 90 comprises three register cards (index cards) 92, 94, 96 on which input and output fields are comprised, via which settings of the user account can be effected.

In FIG. 4, the register card "General" is activated. In the display field 98, after the selection of the user account, a password for authentication is input that later serves for authentication, given a call of the user account. It is thus checked with the aid of the password as to whether the operating personnel is authorized to call, i.e. to select the user account. The password input in the input field 98 is again input in the input field 100 for confirmation, in order to determine writing errors. With the aid of a graphical shift regulator 102, an authorization level of the user account can be adjusted, whereby preset access rights are assigned to the user account in a simple manner.

Figure 5:
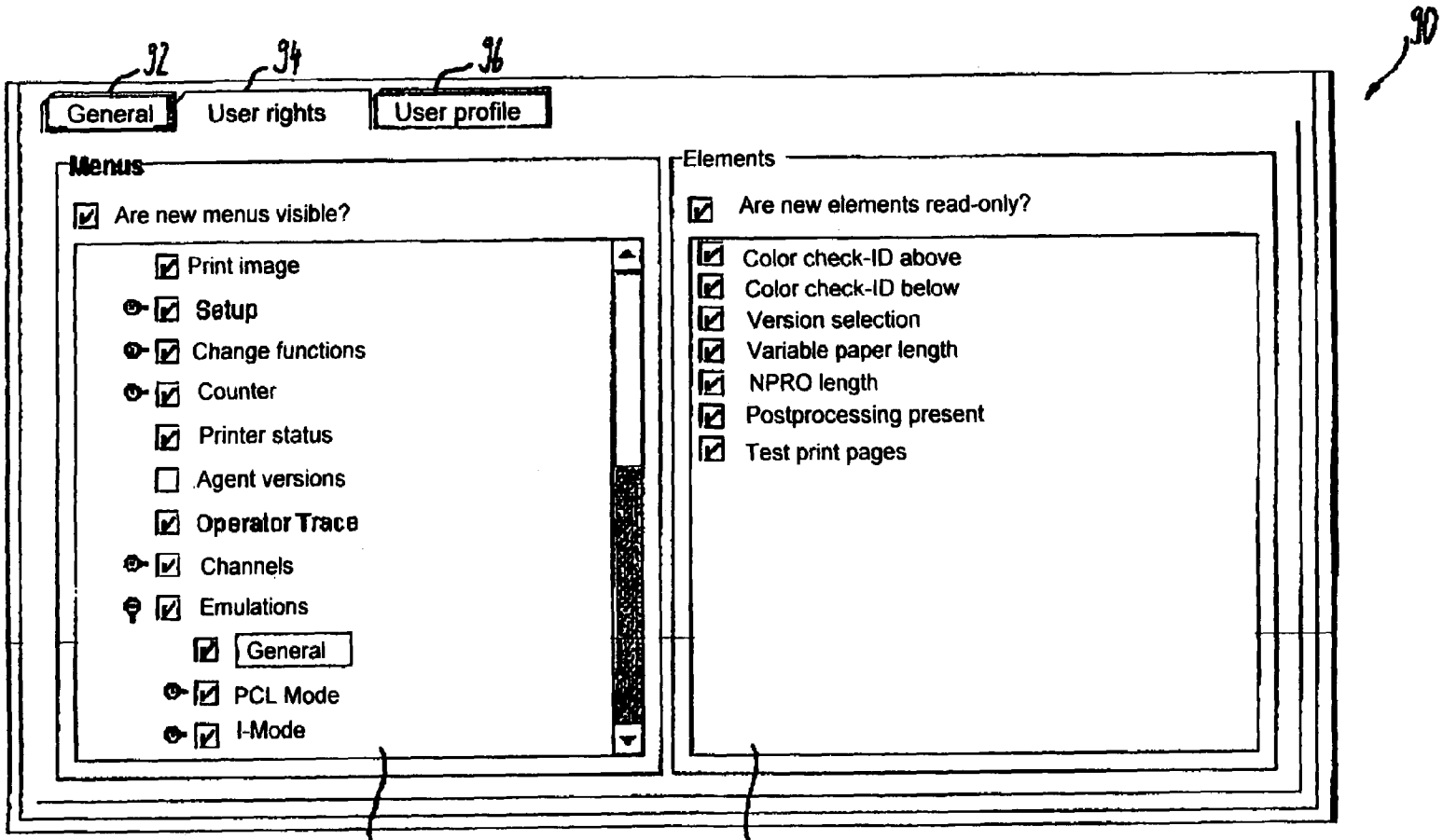
FIG. 5 shows a control panel to configure display elements for a user account.

The user interface 90 according to FIG. 4 is shown in FIG. 5, whereby the register card 92 "User Rights" is activated. With the aid of graphical function keys (what are known as check boxes) it can be preset in the section 104 which menu items and display elements are comprised in the graphical user interface 42 that is output with the aid of the operating unit according to the selection of the user account. With the aid of the check boxes, it can thereby be selected in the display region 104 whether individual user interfaces can be selected at all, and in display region 106 individual elements of the respective user interface can be deactivated, whereby the elements of the menu item "General" listed in the display region 106 apply in the submenu "Emulation". In the display region 106, a check box is then associated with each display element, by activation of which the element is displayed and by deactivation of which the respective graphical element and/or input/output field is or is not shown on the user interface selected in the menu 104. By deactivating the submenu overall in the menu 104, all elements in the region 106 are deactivated. In the menu 46 of the graphical user interface 42, deactivated menu items are shown with a grey text color, and activated menu items are shown with a black color.

In other exemplary embodiments, the deactivated menu items are not shown. The deactivated user interfaces are then not selectable. In the same manner, the individual graphical display elements can be shown in a deactivated display method, for example in a grey-scale display, whereby activated display elements are shown in another, higher-contrast color.

Figure 6:
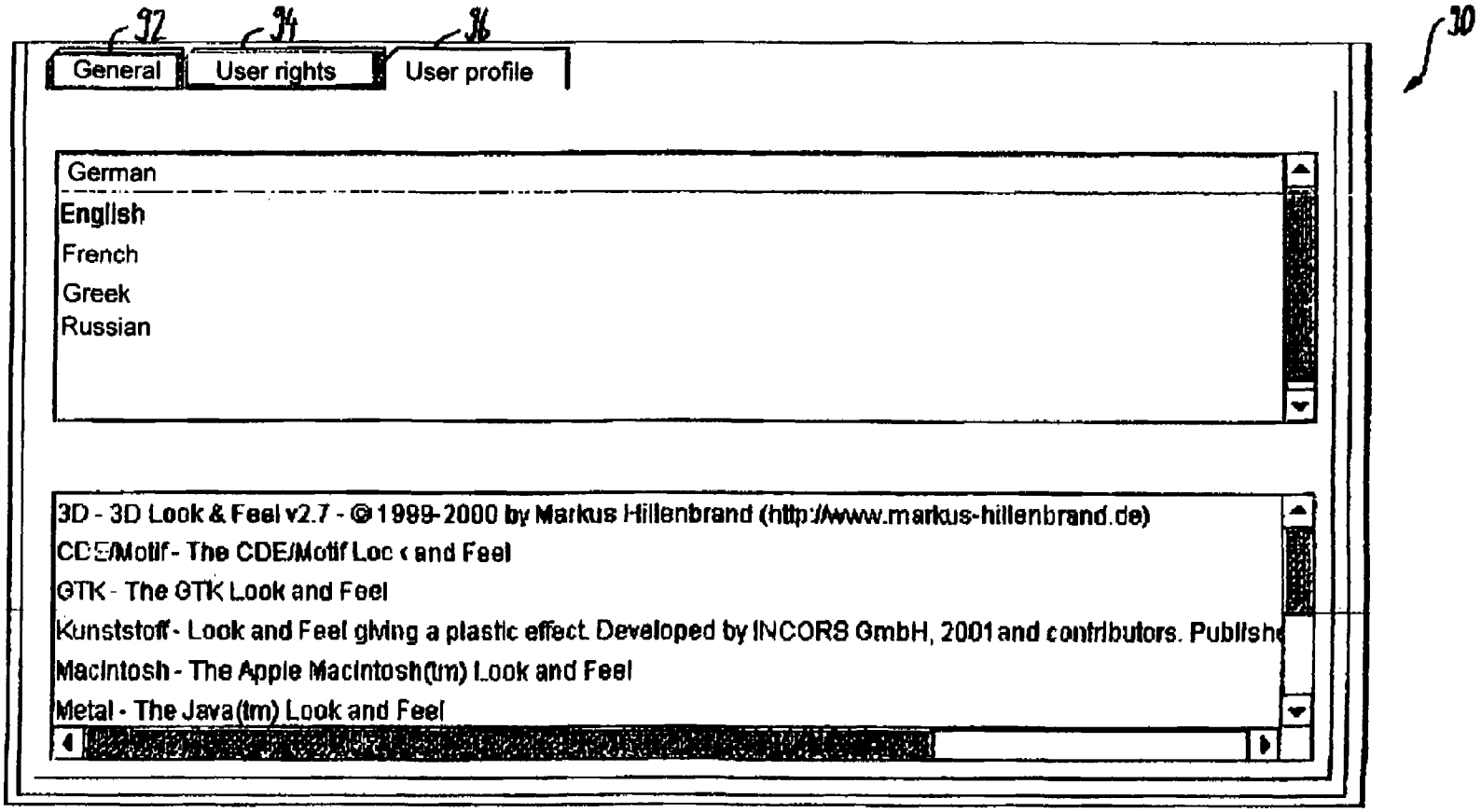
FIG. 6 illustrates a control panel fur further adjustments for a user account.

The user interface 90 according to FIGS. 4 and 5 is shown in FIG. 6, whereby the register card 96 "User Profile" has been selected. With the aid of the setting possibilities of this register card 96, the language of text output fields of the graphical user interface 42 can be individually adjusted for the respective user account. In the present exemplary embodiment, a language is selectable from the languages German, English, French, Greek and Russian. Furthermore, further display options can be input on this register card.

Figure 7:
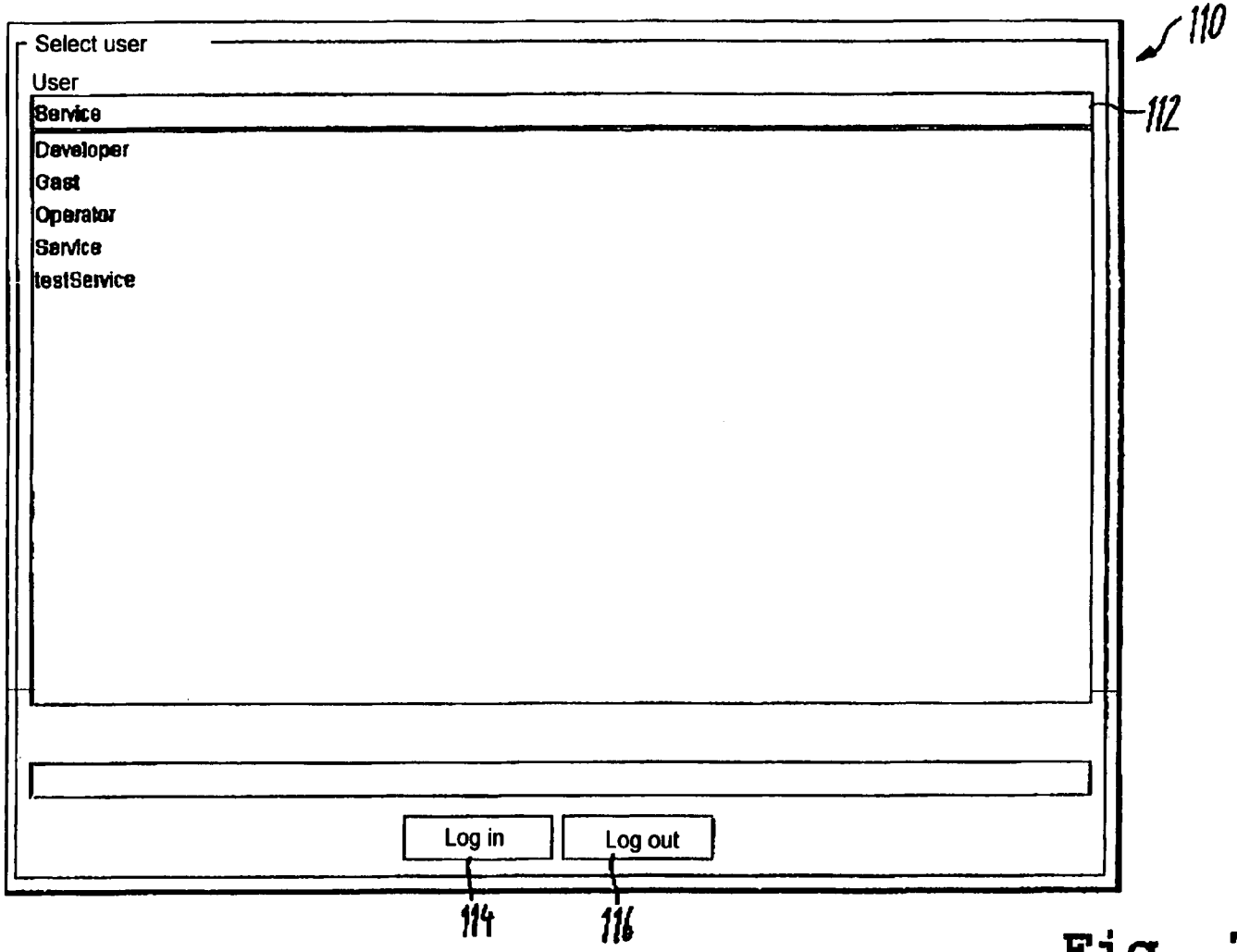
FIG. 7 illustrates a control panel to select a user account from a plurality of configured user accounts.

A user interface 110 to select a user account is shown in FIG. 7. The user interface 110 is, for example, shown in a display region 48 of the graphical user interface 42 after the activation of the graphical function key 75 in the display region 48. The user interface 110 comprises the already set user accounts "Developer", "Guest", "Operator", "Service" and "Test Service". An operating personnel can select one of these already configured user accounts. The selected user account is shown in the display region 112 of the user interface. After the input of a password associated with the user account and activation of the graphical function key 114, the graphical user interface 42 is shown in a configuration dependent on the settings of the user account.

In the present exemplary embodiment, the user account "Service" is selected, whereby after the input of the correct password and logging on to the graphical user interface, user interfaces can also be selected with the aid of the menu that are only configured for maintenance and service tasks and receive no access by the other operating personnel. After the end of a service use, the user account can again be logged off by calling the user interface 110 and activating the graphical function key 116, whereby then no user account is activated. Alternatively, another user account can also be selected, whereby after logging on to the selected user account the user account logged on to is deactivated and the currently selected user account is activated.

Although preferred exemplary embodiment are shown and specified in detail in the drawings and in the previous specification, this should be viewed as being purely exemplary, and the invention should not be viewed as limited thereby. It is to be noted that only the preferred exemplary embodiments are shown and specified, and all changes and modifications that presently and in the future lie in the scope of protection of the invention should be protected.

We claim as our invention:

1. An operating unit for an electrophotographic printing or copying system, comprising:

a graphical user interface with input or output fields with help of which the electrophotographic printing or copying system is operated;

at least two preset user accounts;

upon establishing or configuring a user account, possible input or output fields, that can be displayed with help of the user interface, are activated or deactivated;

the input or output fields to be displayed with the help of the graphical user interface are preset and assigned to every user account;

the input or output fields comprising graphical shift regulators and check boxes;

a user account being selectable from at least said two preset user accounts;

according to the user account selected, a graphical user interface having the assigned input or output fields is output; and with help of the user accounts, different access rights to operating functions of the printing or copying system are obtained.

2. The operating unit according to claim 1 wherein presetting concerns at least one of display, write authorization, language, activation/deactivation, or display manner of the input or output field.

3. The operating unit according to claim 1 wherein a name of a currently set user account or a name of a user assigned to the user account are displayed in a portion of the graphical user interface.

4. The operating unit according to claim 1 wherein the user account is selected with help of the user name.

5. The operating unit according to claim 4 wherein an operating personnel inputs or selects the user name so that the operating personnel has access to operating elements of the graphical user interface.

6. The operating unit according to claim 1 wherein the user account is selectable after checking an authentication code.

7. The operating unit according to claim 6 wherein the authentication code is provided in data of a storage card, in biometric features of the operating personnel, or in a password.

8. The operating unit according to claim 1 wherein for generating a user account, a user name is assignable to a preset user account type, so that a preset authorization level is assigned to the user account.

9. The operating unit according to claim 8 wherein depending on the authorization level assigned to the user account, display or input fields are deactivated, wherein input fields, output fields, or menu fields are shown deactivated.

10. The operating unit according to claim 9 wherein given a deactivated display, a deactivated field or a deactivated menu item are shown in a low-contrast color in comparison to a surrounding field of the menu item.

11. The operating unit according to claim 1 wherein the input or output fields also comprise graphical function keys or menu items.

12. A method for operating an electrophotographic printing or copying system, comprising the steps of:

operating the electrophotographic printing or copying system with help of a graphical user interface having input or output fields;

providing at least two preset user accounts;

upon establishing or configuring a user account, possible input or output fields are displayable with help of the user interface;

presetting and assigning to every user account the input or output fields to be displayed with help of the graphical user interface, said input or output fields comprising graphical shift regulators and check boxes;

selecting a user account from the at least two preset user accounts;

according to the user account selected, outputting a graphical user interface having the assigned input or output fields; and with help of the user accounts, obtaining different access rights to operating functions of the printing or copying system.

13. A graphical user interface for operating an electrophotographic printing or copying system, comprising:

input or output fields with help of which the electrophotographic printing or copying system is operated;

at least two presettable user accounts;

upon establishing or configuring a user account, possible input or output fields which are activated or deactivated are displayed with the graphical user interface;

the input or output fields displayed with the graphical user interface are preset and assigned to every user account;

said input or output fields comprising graphical shift regulators and check boxes;

a user account selectable from the at least two presettable user accounts;

according to the user account selected, the graphical user interface having the assigned input or output fields is generated and output; and with the user accounts, different access rights to operating functions of the printing or copying system are obtained via the user interface.

14. A graphical user interface according to claim 13 wherein an input field of the graphical user interface is shown deactivated when, due to an operating state of the printing or copying system, a display value is not available, and an input field is shown deactivated when, due to an operating state of the printing or copying system, no input can be made.

15. A method for operating an electrophotographic printing or copying system, comprising the steps of:

operating the electrophotographic printing or copying system with help of a graphical user interface having input or output fields;

providing at least two preset user accounts;

upon establishing or configuring a user account, activating or deactivating possible input or output fields that are displayable with help of the user interface;

presetting and assigning to every user account the input or output fields to be displayed with help of the graphical user interface, said input or output fields comprising graphical shift regulators and check boxes;

selecting a user account from the at least two preset user accounts;

according to the user account selected, outputting a graphical user interface having the assigned input or output fields;

with help of the user accounts, obtaining different access rights to operating functions of the printing or copying system; and individually determining for every user account which menu items and display elements are to be provided in the graphical user interface.

16. A method of claim 15 wherein for every user account in addition to an authorization level, the input or output fields to be displayed with aid of the graphical user interface are assigned and preset.

* * * * *